US005715689A

United States Patent [19]

Byczynski et al.

[11] Patent Number: 5,715,689

[45] Date of Patent: Feb. 10, 1998

[54] EVAPORATOR FOR COMBINATION REFRIGERATOR/FREEZER

[75] Inventors: Dean G. Byczynski, Milwaukee; Karl R. Krumbiegel, Brown Deer; William A. Reed, Cedarburg; Jeffrey A. Ziminski, Milwaukee, all of Wis.

[73] Assignee: U-Line Corporation, Milwaukee, Wis.

[21] Appl. No.: 627,164

[22] Filed: Apr. 3, 1996

[51] Int. Cl.[6] ..... F25B 47/02

[52] U.S. Cl. ..... 62/81; 62/278; 62/283; 62/524

[58] Field of Search ..... 62/81, 278, 503, 62/515, 524, 283

[56] References Cited

U.S. PATENT DOCUMENTS

| | | | |
|---|---|---|---|
| 2,929,229 | 3/1960 | Detwiller | 62/283 |
| 3,099,914 | 8/1963 | De Witt et al. | 62/283 X |
| 3,195,320 | 7/1965 | Kita | 62/276 |
| 3,274,797 | 9/1966 | Kritzer | 62/511 |
| 4,679,410 | 7/1987 | Drayer | 62/524 X |
| 4,995,245 | 2/1991 | Chang | 62/515 |
| 5,065,584 | 11/1991 | Byczynski et al. | 62/81 |
| 5,186,022 | 2/1993 | Kim | 62/515 |
| 5,241,838 | 9/1993 | Kennedy | 62/515 |
| 5,345,778 | 9/1994 | Roberts | 62/524 X |

*Primary Examiner*—Harry B. Tanner
*Attorney, Agent, or Firm*—Quarles & Brady

[57] ABSTRACT

A refrigerant evaporator has a first heat exchange portion with an uninterrupted surface formed from sheets of conductive material joined together to form passages therebetween. A second heat exchange portion is connected to and adjacent the first portion. The second portion is formed from hollow, serpentine tubes with spine fins. Condensed refrigerant passes through the first portion, which accummulates frost and ice, and then through the second portion. The first portion also includes a labyrinth of passages that define an accumulator for refrigerant that has passed through the second heat exchange portion.

10 Claims, 4 Drawing Sheets

FIG. 3
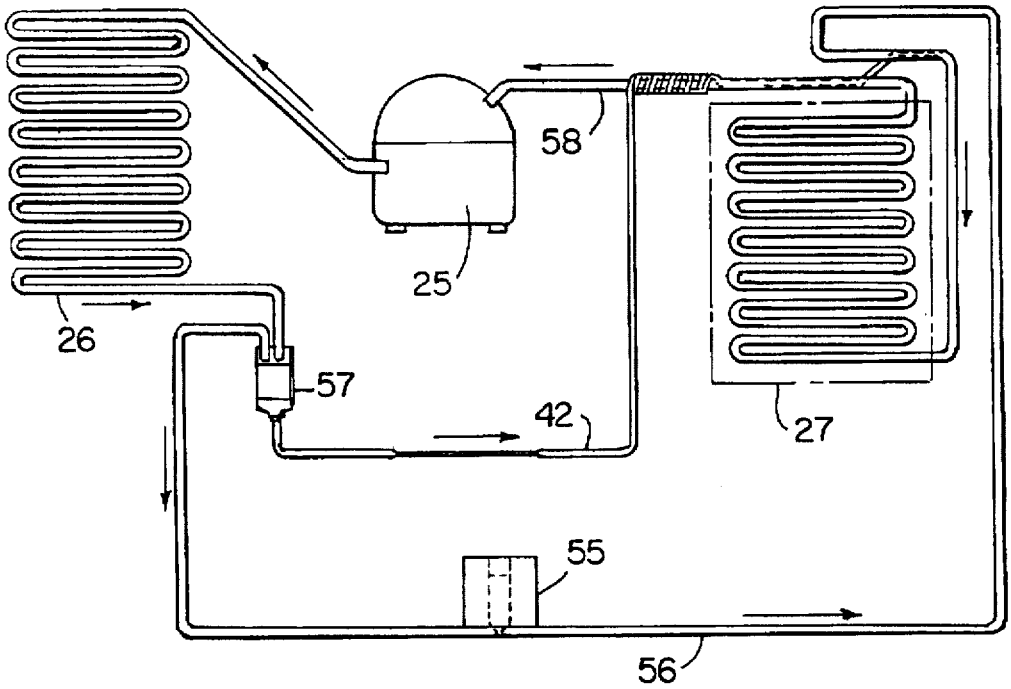
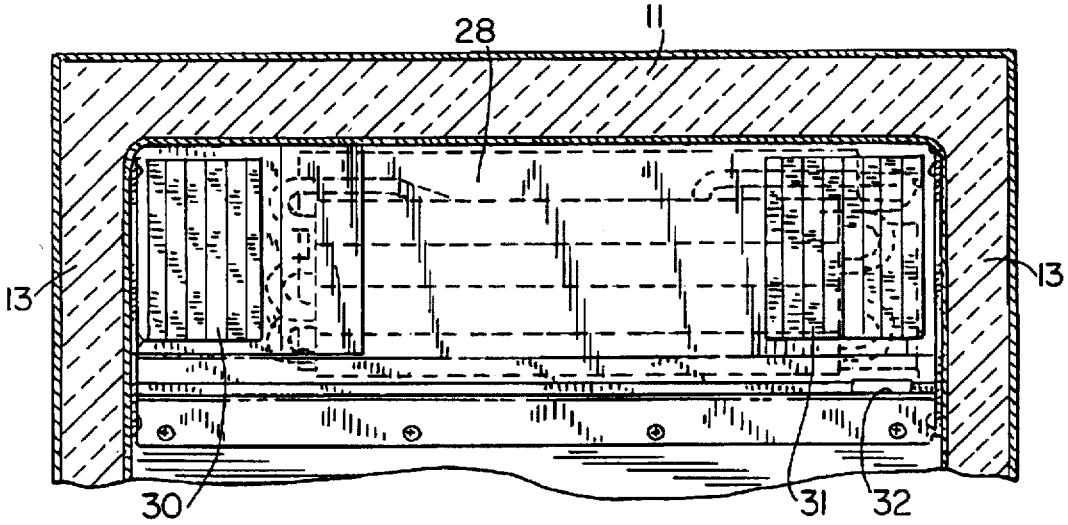
FIG. 4

56
58
42
6
6
35
27
54
54
53

58
42
56
43
52
8
8
45
9
9
44
35
40
50
41
53
53

FIG. 6
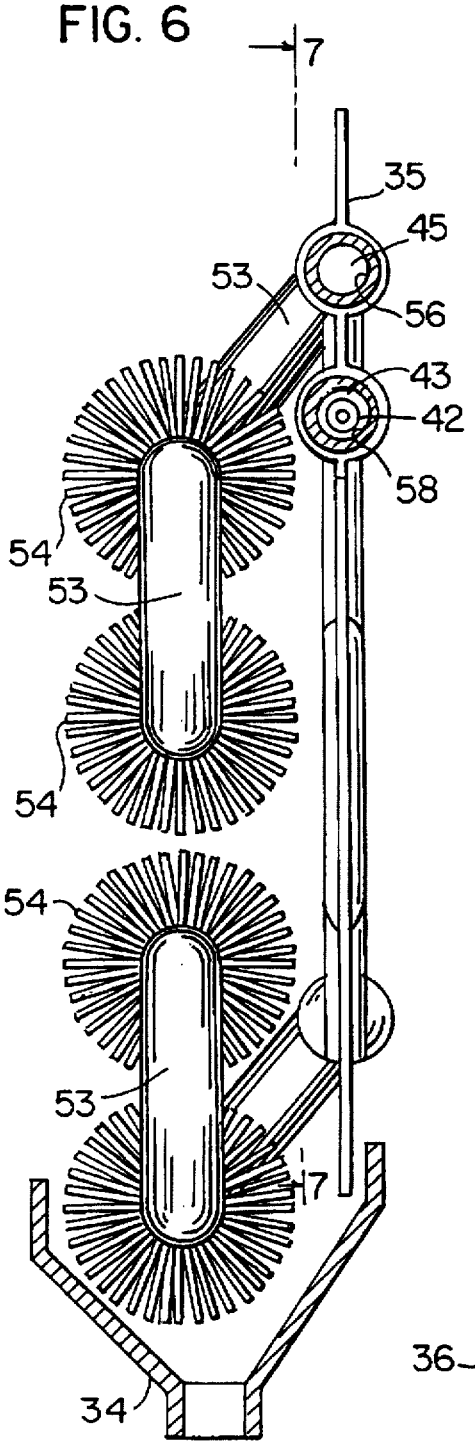
FIG. 8
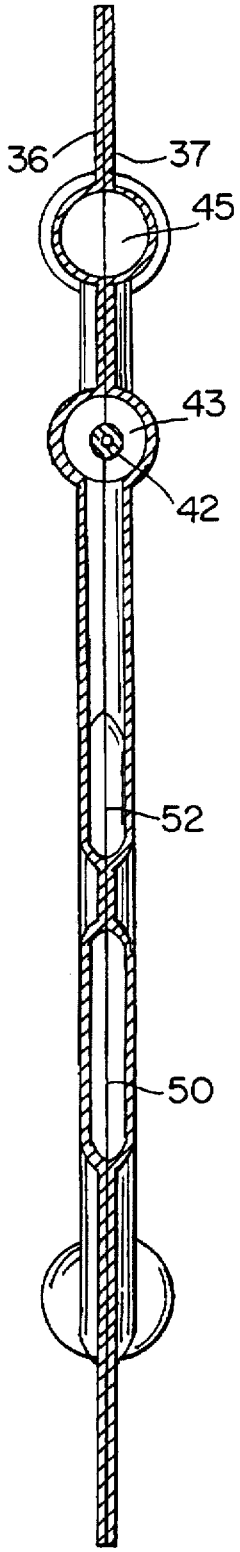
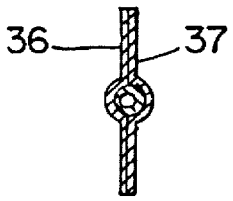
FIG. 9

EVAPORATOR FOR COMBINATION REFRIGERATOR/FREEZER

BACKGROUND OF THE INVENTION

This invention relates to refrigeration systems and particularly to an evaporator for automatically defrosted refrigeration systems.

Evaporators receive condensed refrigerant that is pumped by a compressor, through a condenser, and a flow restricting device to the evaporator. The condensed refrigerant evaporates in the evaporator to thereby extract heat from the evaporator and the surrounding environment. The very cold temperature of the evaporator will generally result in the formation of frost on the surface of the evaporator. This eventually results in a build-up of ice which significantly reduces the heat transfer efficiency due to the insulating effect of the ice. The evaporator must be periodically defrosted in order to remove the accumulated ice.

The common methods for defrosting include the use of electrically resistance heaters, reversing the flow of pressurized refrigerant from the compressor to send the "hot" refrigerant from the compressor directly into the evaporator thereby causing the evaporator to function as a condenser, and bypassing the refrigerant from the condenser directly to the evaporator without passing through the flow restricting device. An example of the latter approach is found in U.S. Pat. No. 5,065,584 issued Nov. 19, 1991, for "Hot Gas Bypass Defrosting System" and assigned to the assignee of this invention.

The present invention is directed to an evaporator which is particularly useful in refrigeration systems that use hot gas bypass for automatic defrosting. The invention is also directed to an evaporator assembly including such an evaporator.

SUMMARY OF THE INVENTION

In accordance with the invention, a refrigerant evaporator has a first heat exchange portion of significant surface area but low surface area density, and a second heat exchange portion having a large surface area and high surface area density.

The second portion is connected to and adjacent the first portion. Condensed refrigerant passes first through the first portion of the evaporator and then the second portion during normal refrigeration. Uncondensed refrigerant also passes through the first portion and then the second portion during the defrost cycle.

Preferably, the first portion is formed from sheets of conductive material, such as aluminum, that are joined together to form passages therebetween. The second portion is preferably formed from hollow tubes arranged in a serpentine shape and with spine fins extending from the tube surface.

In the preferred embodiment, the first portion of the evaporator also includes a labyrinth of passages that define an accumulator for refrigerant that has passed through the second portion of the evaporator.

Also in accordance with the invention, a method of evaporating condensed refrigerant includes the steps of passing the condensed refrigerant through a first heat exchanger of substantial surface area but of low surface area density, and thereafter, passing the refrigerant through a second heat exchanger of large surface area and high surface area density. The method encourages the formation of frost and ice on the first heat exchanger.

The method may further include defrosting the heat exchangers by passing uncondensed refrigerant through the first heat exchanger and then through the second heat exchanger.

The invention further resides in an evaporator assembly for a freezer compartment which includes the evaporator of this invention mounted adjacent the rear of the compartment, a fan adjacent one end of the evaporator, and a shroud in front of the fan and the evaporator. The shroud has entrance air openings near the fan and exit air openings near the other end of the evaporator. Air is drawn by the fan from the compartment, over the evaporator, and back to the compartment. Preferably, the shroud also includes an opening to direct air into a lower refrigerator compartment.

It is an object of the invention to provide a refrigerant evaporator in which the evaporator has a heat exchange portion specifically designed to accumulate frost and ice and which portion is readily defrosted.

It is also an object of the invention to provide an evaporator in which the portion of the surfaces that accumulate frost and ice are formed as bonded sheets that include passageways for accumulating the refrigerant.

It is a further object of the invention to provide a refrigerant evaporator having two heat exchange portions, one of which is characterized by a substantial surface area of low surface area density to accumulate frost and ice, and the other of which has a large surface area and high surface area density that will be generally free of frost and ice.

It is another object of the invention to provide an evaporator assembly including such an evaporator, a fan for the evaporator and a shroud to direct air flow from a refrigerated chamber, through the fan, over the evaporator, and back to the chamber.

The foregoing and other objects of the invention will appear from the detailed description which follows. In the description, reference is made to the accompanying drawings which illustrate a preferred embodiment of the invention.

BRIEF DESCRIPTION OF THE DRAWINGS

FIG. 3 is a schematic view of a refrigeration system incorporating the evaporator of the present invention;

FIG. 4 is a view in elevation and partially in section taken in the plane of the line 4—4 in FIG. 1;

FIG. 6 is an enlarged end view of the evaporator of FIG. 5 taken in the plane of the line 6—6 in FIG. 5;

FIG. 8 is a view in vertical section taken in the plane of the 8—8 of FIG. 7; and FIG. 9 is a view in vertical section taken in the plane of the line 9—9 in FIG. 7.

DETAILED DESCRIPTION OF THE PREFERRED EMBODIMENT

Figure 1:
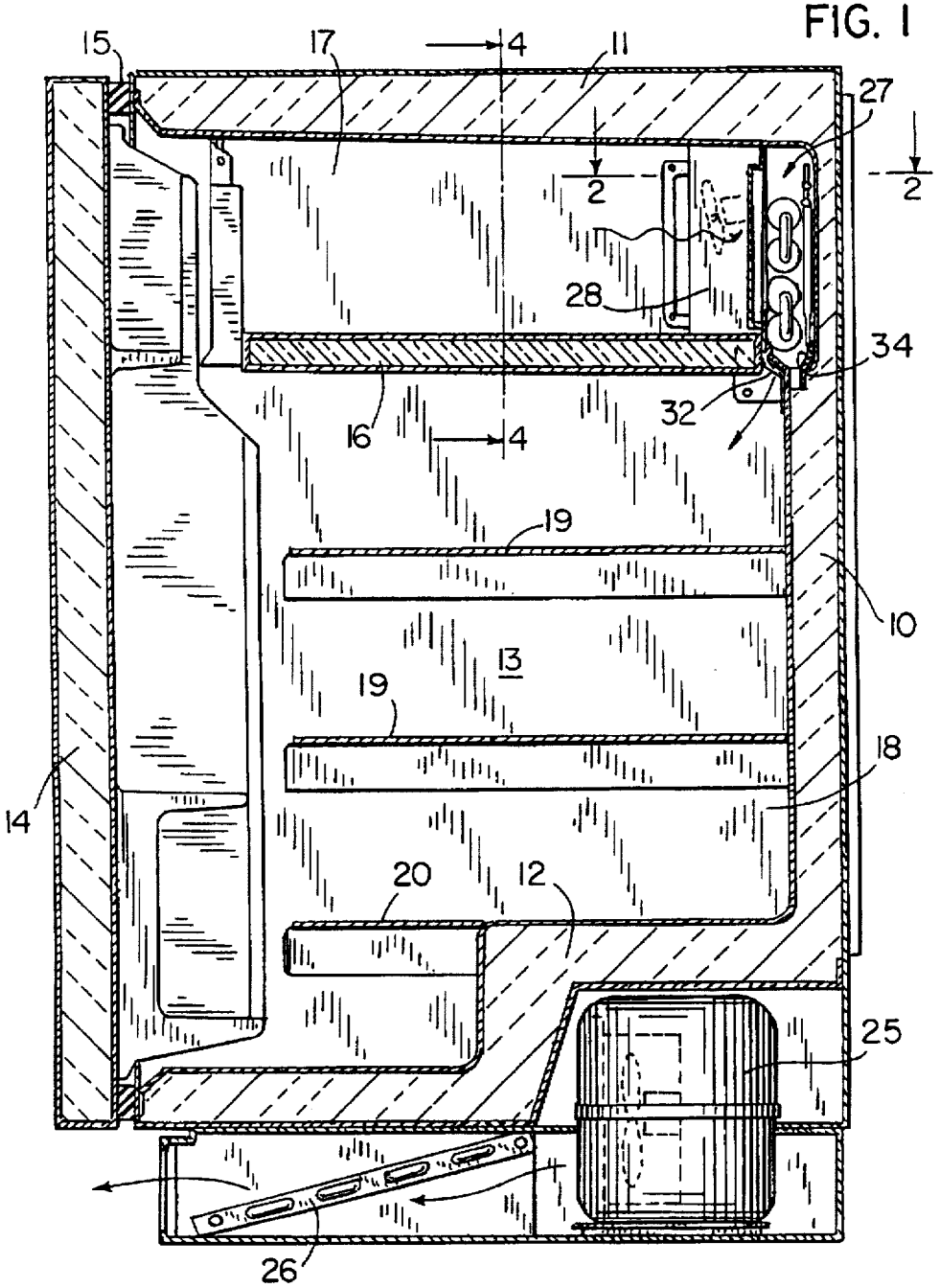
FIG. 1 is a view in vertical section of a combination refrigerator/freezer which incorporates the present invention.

The evaporator and evaporator assembly are particularly useful in an undercounter combination refrigerator/freezer of the type shown in FIG. 1. The refrigerator/freezer includes an insulated cabinet with a rear wall 10, a top wall 11, a bottom wall 12, and side walls 13. An insulated door 14 has a peripheral seal 15 that closes with the open front of the cabinet. An insulated shelf 16 divides the interior of the cabinet into an upper freezer compartment 17 and a lower refrigerator compartment 18. The refrigerator compartment 18 may include support shelves 19 and 20. A motor driven compressor 25 is mounted beneath the cabinet, as is a condenser 26.

Figure 2:
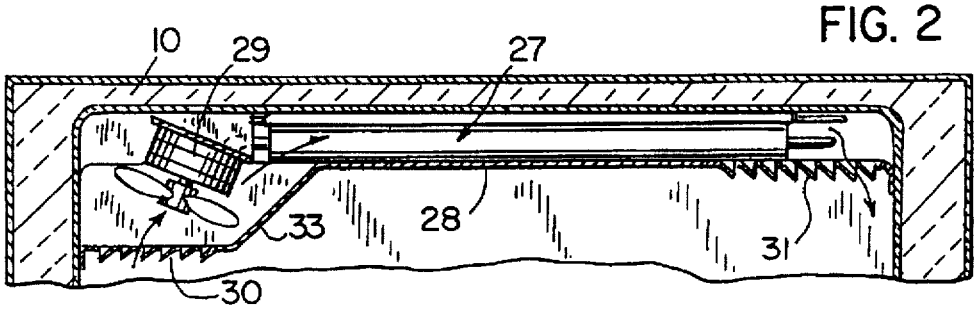
FIG. 2 is a partial view in horizontal section taken in the plane of the line 2—2 of FIG. 1.
Figure 5:
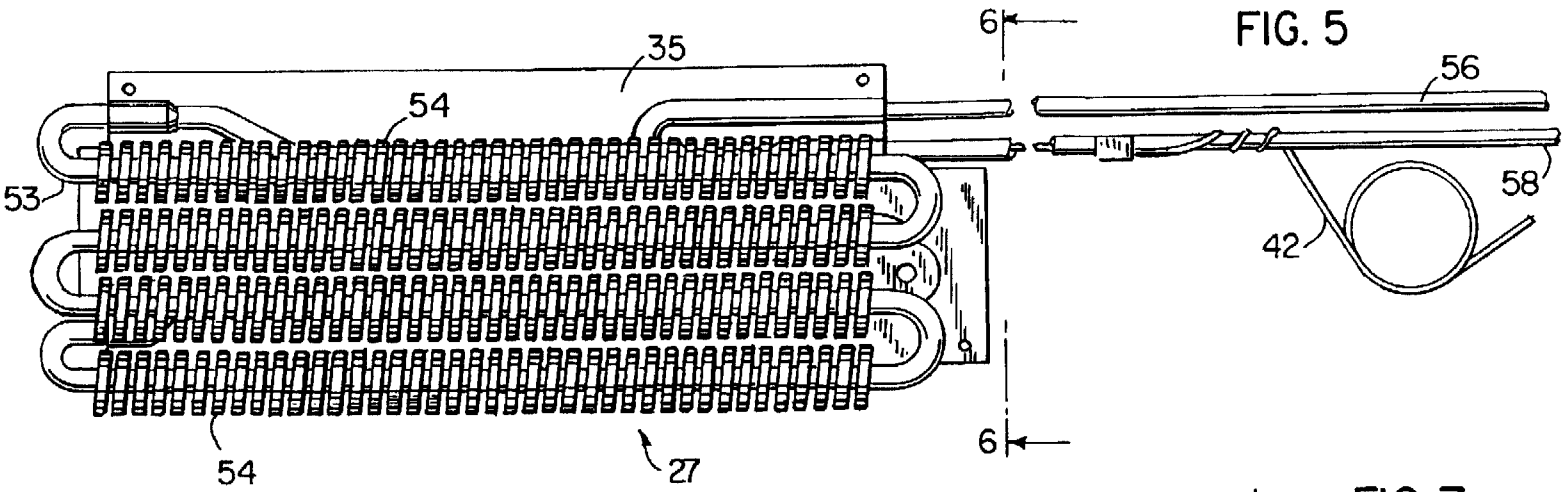
FIG. 5 is a view in elevation of the evaporator of the present invention.
Figure 7:
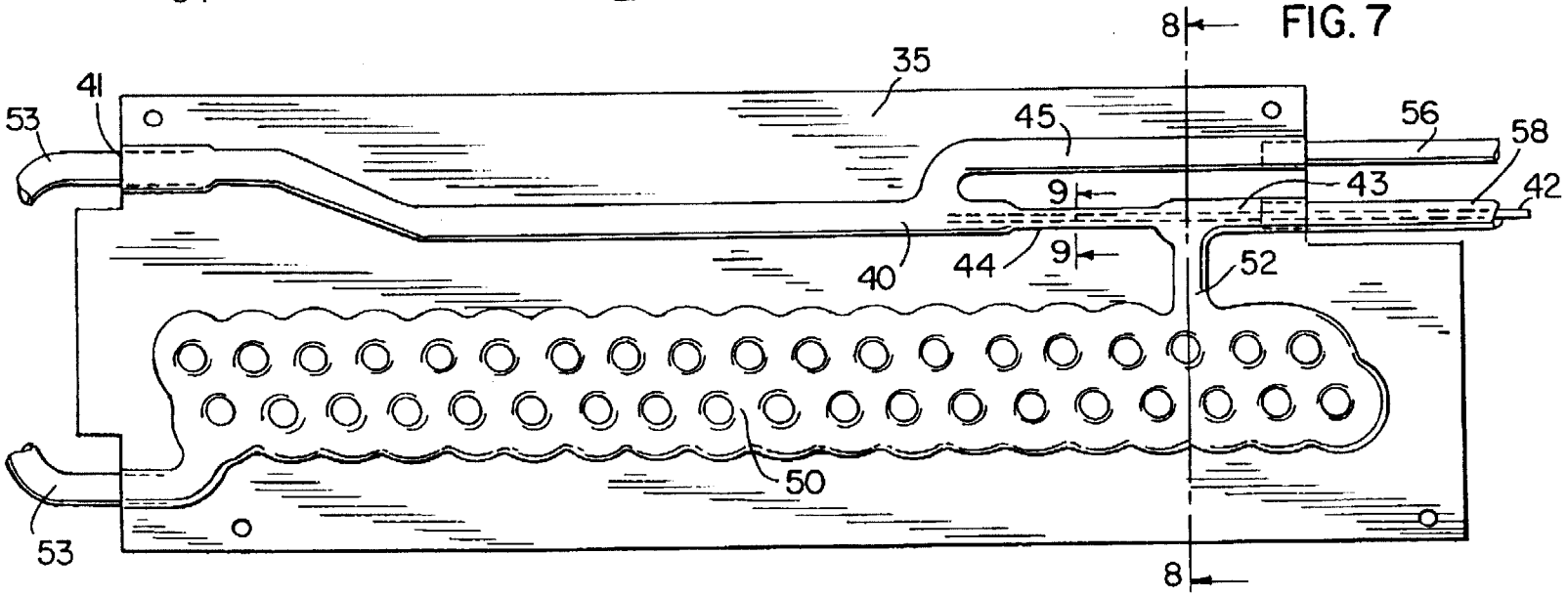
FIG. 7 is a view in elevation of a portion of the evaporator of FIG. 5 taken in the plane of the line 7—7 of FIG. 6.

The evaporator indicated generally by the numeral 27 is mounted in a cavity in the rear wall 10 at the rear of the freezer compartment 17. A shield 28 separates the evaporator 27 from the rear of the freezer compartment 17. An evaporator fan 29 is mounted behind the shield 28 near one end of the evaporator 27. As shown in FIG. 2, the shield 28 has a series of inlet air openings 30 adjacent to the fan 29. The fan 29 is driven in a direction such that it will draw air through the inlet openings 30 and pass the air over the surfaces of the evaporator 27. The shroud 28 also includes exit air openings 31 which pass the cooled air from the evaporator 27 back into the freezer compartment 17. A relatively small horizontal opening 32 at the base of the shroud 28 directs air from the surface of the evaporator 27 to the refrigeration compartment 18 beneath the insulated shelf 16. As shown in FIG. 2, the shroud 28 is provided with a forward offset 33 to accommodate the evaporator fan 29, but otherwise the surface of the shroud 28 hugs that of the evaporator 27. A drip pan 34 is disposed directly beneath the evaporator 27.

As shown particularly in FIGS. 5 through 9, the evaporator 27 is formed with two heat exchanger portions having two distinct surface areas. A first portion 35 is formed as a plate by rolling and bonding two aluminum sheets 36 and 37 together in what is commonly known as a "roll-bond" construction. The result of the fabrication method is the formation of a series of internal passageways between the two sheets 36 and 37. In the evaporator of the invention, one such passageway is an inlet passage 40 which has an outlet 41 at one end of the first portion 35. A capillary tube 42 extends through a suction passage 43 also formed in the first portion 35. The end of the capillary tube 42 opens into the inlet passage 40. The sheets 36 and 37 are crimped at an area 44 behind the open end of the capillary tube 42 to restrict flow between the inlet passage 40 and the suction passage 43. A bypass passage 45 is formed between the sheets 36 and 37 and connects into the inlet passage 40 in the vicinity of the end of the capillary tube 42.

Also formed between the sheets 36 and 37 is a labyrinth passageway 50 defining an accumulator. An inlet 51 extends from one end of the first portion 35 to the accumulator labyrinth 50 and the suction passage 43 is connected to the labyrinth 50 by a branch passage 52.

The first portion 35 has a substantial heat conductive surface area for heat exchange, but the surface area is of low density in relation to the volume of space occupied by the first portion 35. The evaporator of this invention also has a second heat exchanger portion that has a large surface area and a high surface area density in relation to the volume of space which it occupies.

The second portion includes a serpentine tube 53 having one end mounted in the outlet passage 41 and a second end mounted in the inlet passage 51 of the first portion 35. The serpentine tube 53 has runs that extend back and forth across the surface but spaced from the first portion 35. The serpentine tube 53 mounts heat exchange coils 54 that may take the form of a spine fin ribbon of the type shown, for example, in U.S. Pat. No. 5,241,838 issued Sep. 7, 1993, for "Refrigerator With Spine Fin Evaporator". The coils 54 provide a very large surface area for maximum heat exchange.

FIG. 3 shows the refrigerant system using the evaporator of this invention in schematic form. During the normal refrigeration cycle, a solenoid valve 55 closes a bypass line 56 which leads to the bypass passage 45 in the first portion 35. The bypass line 56 is connected to a dryer 57 that is connected to the outlet of the condenser 26. The capillary tube 42 is also connected to the dryer 57. With the solenoid valve 55 closed, the compressor 25 draws evaporated refrigerant from a suction line 58 connected to the suction passage 43 of the first portion 35 and delivers the refrigerant to the condenser 26. The refrigerant entering the condenser is cooled by air movement thereby extracting heat from the refrigerant. As the temperature of the refrigerant drops under the substantially constant pressure maintained by the compressor 25 and the flow restriction of the capillary tube 42, the refrigerant in the condenser liquifies or condenses, thereby losing additional heat due to latent heat evaporization.

The condensed or liquified refrigerant passes into the evaporator 27 through the capillary tube 42. Since the evaporator 27 is at a low pressure as a result of the pumping of the compressor 25 and the restricted flow from the capillary tube 42, the liquified refrigerant evaporates in the evaporator. The liquified refrigerant first encounters the inlet passage 40 which is adjacent to the large flat surface area of the first heat exchanger portion 35. Since that is the coldest area of the evaporator, frost and ice will tend to build up on that area. The refrigerant continues to travel through the high-density surface area of the tube 53 and coils 54 where the major heat transfer between the evaporator and the air takes place. Finally, the evaporating refrigerant passes into the labyrinth 50 where it accumulates before being drawn by the compressor 25 through the suction passages 43 and 52 and the suction line 58.

The solenoid valve 55 is opened for defrosting. This effectively bypasses the capillary tube 42. Since there is no back pressure restriction on the condenser 26, uncondensed refrigerant will flow through the outlet of the condenser 26 and through the bypass line 56 into the inlet passage 40 in the first portion 35. This much warmer refrigerant will defrost the evaporator 27. Since most of the frost and ice will have formed on the first portion 35, the "hot" refrigerant will first encounter and effectively defrost that portion of the evaporator 27.

As shown in FIG. 6, the lowest run of the second heat exchanger portion is close to the drip pan 34. The result is that water that drips from the evaporator 27 will not refreeze during the defrost cycle before the water exits the drip pan.

By providing an evaporator having an initial heat exchange stage that includes a relatively large surface area but of low surface density, followed by a heat exchange stage of high surface area and density, frost is concentrated on the portion of the evaporator that is least efficient at heat transfer and is most easily rid of frost and ice during defrosting. The efficiency is further enhanced by mounting the evaporator with the first portion vertically over and adjacent to a drip pan where water can be collected from the defrosting process. Finally, the overall heat transfer efficiency of the evaporator is enhanced by mounting it in an environment in which air is passed over the evaporator.

We claim:

1. An evaporator for a refrigeration system, comprising:

a first heat exchange portion having a significant uninterrupted surface area and adapted to receive condensed refrigerant, and a second heat exchange portion of high surface area and high surface area density connected to and adjacent the first portion to receive refrigerant leaving the first portion.

2. An evaporator in accordance with claim 1 together with an accumulator having an uninterrupted surface area connected to the second portion and receiving refrigerant leaving the second portion, the accumulator being integral with the first heat exchange portion.

3. An evaporator in accordance with claim 2 wherein the first portion is formed from two heat conductive sheets joined together to define refrigerant passages and flat surface areas.

4. An evaporator in accordance with claim 2 wherein the second portion is a hollow serpentine tube having fins extending from its outer surface.

5. A method of evaporating condensed refrigerant in a refrigeration system, comprising:

passing the condensed refrigerant through a first vertical heat exchanger having a substantial uninterrupted surface area to encourage the formation of frost thereon, and thereafter passing the condensed refrigerant through a second heat exchanger of large surface area and high surface area density that is adjacent to the first heat exchanger.

6. A method of defrosting the heat exchangers of claim 5, comprising:

passing uncondensed refrigerant through the first heat exchanger; and thereafter passing the refrigerant through the second heat exchanger.

7. An evaporator for a refrigeration system, comprising:

a first heat exchange portion comprising vertical sheets of heat conductive material joined together to form passages therebetween and flat surface areas, the passages including an inlet passage and a suction passage, and a second heat exchange portion having a high density surface area spaced from but adjacent to the first portion and having internal passages connected to the passages of the first portion.

8. An evaporator in accordance with claim 7 wherein the first portion includes accumulator passages connected to the suction passage and the internal passages of the second portion.

9. An evaporator in accordance with claim 7 wherein the second portion comprises a hollow serpentine tube having spine fins extending from its outer surface.

10. The combination with an insulated compartment having a rear wall of a refrigerant evaporator assembly comprising:

an evaporator including a first heat exchange portion of significant surface area and low surface area density adapted to receive condensed refrigerant and a second heat exchange portion of high surface area and high surface area density connected to and adjacent the first portion to receive refrigerant leaving the first portion, said evaporator being disposed adjacent said rear wall;

a fan adjacent one end of the evaporator; and a shroud in front of the evaporator and fan, said shroud having entrance air openings near the fan and exit air openings near the other end of the evaporator.

* * * * *